US007568427B2

(12) United States Patent
Grieser et al.

(10) Patent No.: US 7,568,427 B2
(45) Date of Patent: Aug. 4, 2009

(54) INK TRANSFER DEVICE FOR A PRINTING PRESS

(75) Inventors: Alfons Grieser, Sielenbach (DE); Eduard Hoffmann, Bobingen (DE); Georg Schmid, Neusäß (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 129 days.

(21) Appl. No.: 11/404,478

(22) Filed: Apr. 13, 2006

(65) Prior Publication Data

US 2006/0230961 A1 Oct. 19, 2006

(30) Foreign Application Priority Data

Apr. 14, 2005 (DE) ..... 10 2005 017 229

(51) Int. Cl.
*B41F 27/12* (2006.01)

(52) U.S. Cl. ..... 101/415.1; 101/378; 428/909

(58) Field of Classification Search ..... 101/415.1, 101/217, 375, 376; 428/909
See application file for complete search history.

(56) References Cited

U.S. PATENT DOCUMENTS

| | | | | |
|---|---|---|---|---|
| 3,730,092 | A | 5/1973 | Pickard et al. | |
| 4,854,237 | A * | 8/1989 | Theilacker | 101/415.1 |
| 5,131,326 | A * | 7/1992 | Wrzesinski | 101/415.1 |
| 5,357,863 | A | 10/1994 | McLean et al. | |
| 6,073,558 | A | 6/2000 | Jones | |
| 6,231,490 | B1 | 5/2001 | Speil et al. | |
| 2002/0005132 | A1 * | 1/2002 | Yoshizawa et al. | 101/415.1 |
| 2006/0054038 | A1 | 3/2006 | Kummet et al. | |
| 2007/0101884 | A1 * | 5/2007 | Czerner | 101/375 |

FOREIGN PATENT DOCUMENTS

| | | |
|---|---|---|
| DE | 43 20 464 | 12/1994 |
| DE | 203 05 146 | 8/2004 |

OTHER PUBLICATIONS

Search Report dated Apr. 14, 2005 issued for the corresponding German Application No. 10 2005 017 229.6.

* cited by examiner

*Primary Examiner*—Leslie J Evanisko
(74) *Attorney, Agent, or Firm*—Cohen Pontani Lieberman & Pavane LLP

(57) ABSTRACT

An ink transfer device which can be clamped on a rubber covered cylinder in a printing press includes a rubber blanket for transferring ink from a printing forme to a printing material, the blanket having a leading end and a trailing end which are separated by a non-ink transferring gap when the device is clamped on the cylinder; a carrier element fixed to the rubber blanket; and a pair of fixing elements for clamping the blanket on the cylinder, the fixing elements being positioned on the carrier adjacent to respective ends of the blanket. In order to minimize the non-ink transferring gap, the fixing elements and the carrier element are formed as separate subassemblies which are joined together.

16 Claims, 4 Drawing Sheets

INK TRANSFER DEVICE FOR A PRINTING PRESS

BACKGROUND OF THE INVENTION

1. Field of the Invention

The invention relates to an ink transfer device which can be clamped on a rubber covered cylinder in a printing press, including a rubber blanket, a carrier element fixed to the rubber blanket, and a pair of fixing elements for clamping the blanket on the cylinder, the fixing elements being positioned on the carrier adjacent to respective ends of the blanket.

2. Description of the Related Art

In the printing units of a printing press, with the aid of what are known as inking units, printing ink is transferred as a function of a subject onto a printing forme positioned on a forme cylinder of the respective printing unit. With the aid of an ink transfer device, the printing ink applied to the printing forme is transferred to a printing material to be printed. Transfer devices known from the prior art are based either on what are known as rubber blankets or on what are known as rubber sleeves.

Rubber sleeves are formed in the manner of sleeves and, in order to position the same on a rubber-covered cylinder, are pushed onto the rubber-covered cylinder in the axial direction. Rubber sleeves have the advantage that non-ink-carrying gaps or channels in the region of the ink transfer device are avoided. Rubber sleeves of this type therefore benefit a quiet rolling behavior of printing cylinders on one another and in this way minimize cylinder oscillations. Ink transfer devices based on rubber sleeves require a great deal of mechanical effort, however, and are therefore relatively expensive.

By contrast, rubber blankets must be clamped on the rubber-covered cylinder in what are known as clamping channels. The relatively flexible rubber blankets are accommodated on a preferably metallic carrier element, end sections of the carrier element being bent over in order to form fixing elements, which are used for clamping the rubber blanket on the rubber-covered cylinder. According to the prior art, the fixing elements are a constituent part of the carrier element.

During the clamping, non-ink-transferring gaps or channels are formed in between what is known as a leading end and what is known as a trailing end of the rubber blanket, and have a detrimental influence on the rolling behavior of printing cylinders and thus, in particular in the case of relatively slim cylinders and in the case of relatively high rotational speeds of the same, can cause cylinder oscillations. Ink transfer devices based on rubber blankets are certainly less expensive but the print quality that can be realized is restricted with regard to oscillation stripes as compared with ink transfer devices based on rubber sleeves.

SUMMARY OF THE INVENTION

Taking this as a starting point, the present invention is based on the problem of providing a novel ink transfer device for a printing press.

According to the invention, the carrier element and the fixing elements are designed as separate subassemblies in order to minimize the non-ink-transferring gap.

In the spirit of the present invention, an ink transfer device based on rubber blankets is proposed with which non-ink-carrying gaps can be minimized. This makes it possible, even in the case of ink transfer devices which are based on rubber blankets, to minimize the risk of cylinder oscillations and in this way to provide high print qualities. With the ink transfer device according to the invention, non-ink-carrying gaps between the leading end and the trailing end of the rubber blanket can be realized which have a width in the circumferential direction between 0 mm and 1.0 mm. This makes it possible to combine the advantages of ink transfer devices based on rubber sleeves, specifically the minimal tendency to oscillations of the same, with the advantages of ink transfer devices based on rubber blankets, specifically the cost-effective implementation of the same.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

In the following text, the present invention will be described in greater detail with reference to FIGS. 1 to 7.

Figure 1:
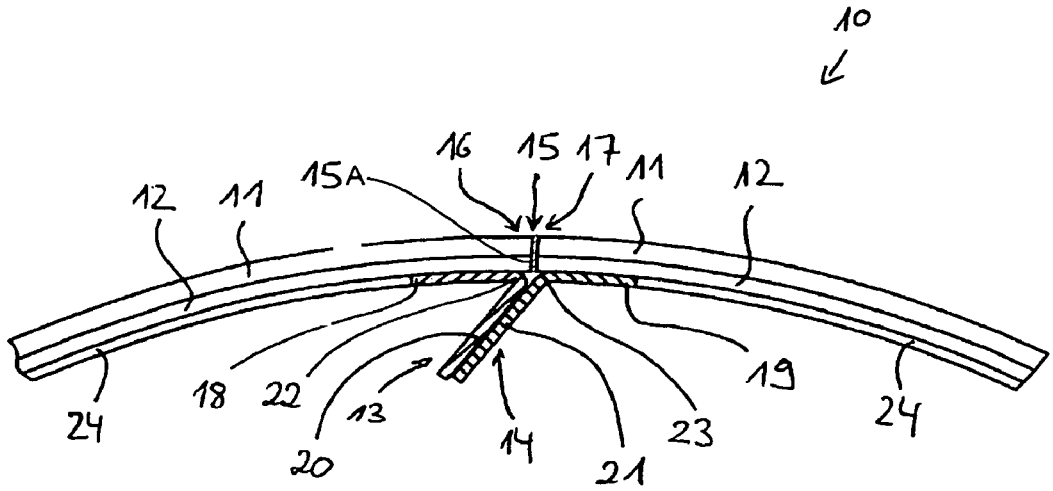
FIG. 1 shows a schematic detail from an ink transfer device according to the invention for a printing press when the same is clamped on a rubber-covered cylinder, in the axial viewing direction according to a first exemplary embodiment of the invention.
Figure 2:
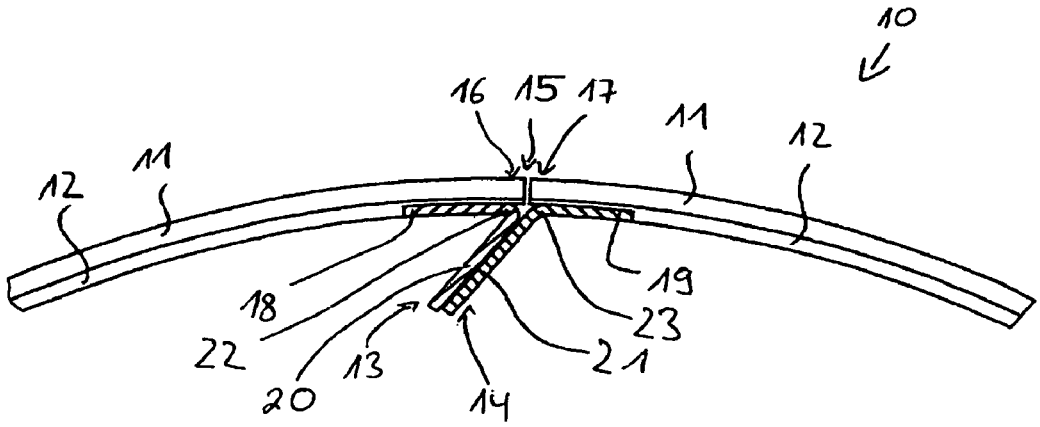
FIG. 2 shows a schematic detail from an ink transfer device according to the invention for a printing press when the same is clamped on a rubber-covered cylinder, in the axial viewing direction according to a second exemplary embodiment of the invention.

FIG. 1 shows a detail from an ink transfer device 10 according to the invention when the device is clamped on a rubber-covered cylinder, not illustrated, the ink transfer device 10 of FIG. 1 including a rubber blanket 11 and a carrier element 12 assigned to the rubber blanket 11. Rubber blanket 11 and carrier element 12 are designed as separate subassemblies in the exemplary embodiment of FIG. 1.

The rubber blanket 11 can be formed in a plurality of layers. The carrier element 12 can be designed as a metal carrier, woven fabric carrier or as a fibre-reinforced plastic carrier. According to FIG. 1, in the clamped state, the carrier element 12 is positioned radially on the inside and the rubber blanket 11 radially on the outside. The carrier element 12 is used to hold the rubber blanket 11. It should be pointed out that the carrier element 12 can also be an integral constituent part of the rubber blanket 11.

In the spirit of the present invention, the ink transfer device 10 has fixing elements 13 and 14 designed as separate subassemblies, in addition to the rubber blanket 11 and the carrier element 12. The fixing elements 13 and 14 are used to clamp the rubber blanket 11 on the rubber-covered cylinder, not illustrated. Because the carrier element 12 and the fixing elements 13 and 14 are designed as separate subassemblies, a non-ink-transferring gap 15, which is formed between a leading end 16 and a trailing end 17 of the rubber blanket 11 when it is clamped on the rubber-covered cylinder, is minimized, so that, seen in the circumferential direction, the gap has a width between 0 mm and 1.0 mm.

According to FIG. 1, a first fixing element 13 is assigned to the leading end 16, and a second fixing element 14 is assigned to the trailing end 17. In the clamped state, the fixing elements 13 and 14 are positioned radially on the inside with respect to the carrier element 12, the carrier element 12 being arranged between the rubber blanket 11 and the respective fixing element 13 or 14 both in the region of the leading end 16 and in the region of the trailing end 17. The fixing elements 13 and 14 have fixing sections 18 and 19 which join the elements 13, 14 firmly to the carrier element 12. The fixing sections 18 and 19 can in this case be joined to the carrier element 12 by means of adhesive bonding, soldering or welding. According to FIG. 1, the fixing elements 13 and 14 also have clamping sections 20 and 21, in addition to the fixing sections 18 and 19. When they are in the clamped state, the clamping sections 20 and 21 are bent over radially inwards with respect to the fixing sections 18 and 19 of the respective fixing element 13 or 14.

According to FIG. 1, the fixing section 18 and the clamping section 20 of the fixing element 13 assigned to the leading end 16 enclose an angle of less than 90°. By contrast, the clamping section 21 and the fixing section 19 of the fixing element 14 assigned to the trailing end 17 enclose an angle of greater than 90°. Between the fixing section 18 or 19 and the clamping section 20 or 21 of the respective fixing element 13 or 14, a bending section 22 or 23 of the respective fixing element 13 or 14 is formed.

Rubber blanket 11 and carrier element 12 have identical dimensions. According to FIG. 1, when they are clamped on the rubber-covered cylinder, the rubber blanket 11 and the carrier element 12 at the leading end 16 and at the trailing end 17, seen in the circumferential direction, project with respect to the fixing section 18 or 19 and the respective bending section 22 and 23, with the effect of an overhang. This makes it possible to minimize the circumferential width of the non-ink-transferring gap 15 in such a way that the same has a width of at most 1 mm.

In the exemplary embodiment of FIG. 1, the fixing elements 13 and 14 are placed on the carrier element 12 radially on the inside via their fixing sections 18 and 19 in the region of the leading end 16 and of the trailing end 17. In the exemplary embodiment of FIG. 1, this results in a thickness difference as compared with the remaining sections of the ink transfer device 10. This thickness difference is compensated for by a compensating element 24, preferably formed as a film. The compensating element 24 is either positioned on the rubber-covered cylinder or firmly connected to the carrier element 12. The compensating element 24 extends between the fixing sections 18 and 19 of the fixing elements 13 and 14 over the entire length of the carrier element 12 and of the rubber blanket 11. The compensating element 24 can be a constituent part of the fixing elements 13 and 14. Alternatively, the fixing sections 18 and 19 of the fixing elements 13 and 14 (see exemplary embodiment of FIG. 2) can be let flush into the carrier element 12 radially on the inside. In this case, the result is no thickness difference and it is possible to dispense with the compensating element 24.

The fixing elements 13 and 14 extend over the entire axial width of the ink transfer device 10 and therefore of the rubber-covered cylinder on which the ink transfer device 10 is clamped. The same applies to the non-ink-transferring gap 15 which is formed between the leading end 16 and the trailing end 17. The non-ink-transferring gap 15 can be sealed 15A in order to avoid the penetration of media into the same.

Figure 3:
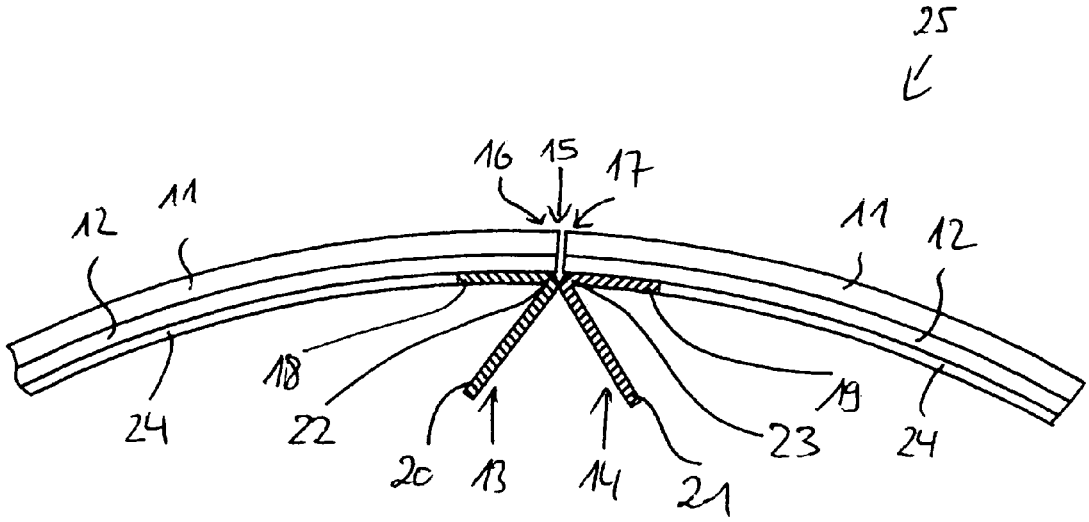
FIG. 3 shows a schematic detail from an ink transfer device according to the invention for a printing press when the same is clamped on a rubber-covered cylinder, in the axial viewing direction according to a third exemplary embodiment of the invention.
Figure 4:
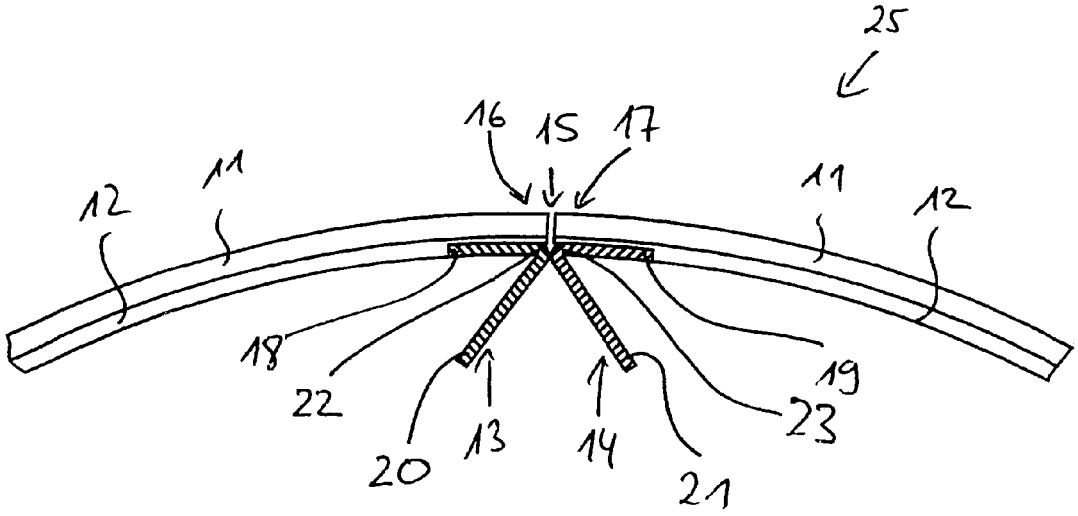
FIG. 4 shows a schematic detail from an ink transfer device according to the invention for a printing press when the same is clamped on a rubber-covered cylinder, in the axial viewing direction according to a fourth exemplary embodiment of the invention.

Further exemplary embodiments of an ink transfer device 25 according to the invention are shown by FIGS. 3 and 4. The ink transfer devices 25 of FIGS. 3 and 4 correspond substantially to the ink transfer devices 10 of FIGS. 1 and 2, so that the same reference numbers are used for the same subassemblies. In order to avoid unnecessary repetitions, only the details by means of which the ink transfer devices 25 of FIGS. 3 and 4 differ from the ink transfer devices 10 of FIGS. 1 and 2 will be discussed below.

In the exemplary embodiments of FIGS. 3 and 4, the clamping sections 20 and 21 of the fixing elements 13 and 14, both in the region of the leading end 16 and in the region of the trailing end 17, are bent over with respect to the fixing sections 18 and 19 so that the clamping sections 20, 21 form acute angles with the fixing sections 18, 19. This makes it possible, when clamping the ink transfer device 25, to apply a prestress to the same and to select the direction of movement during clamping as desired. In the exemplary embodiment of FIG. 2, each of the two ends 16 and 17 can accordingly be used as a leading end or as a trailing end.

Figure 7:
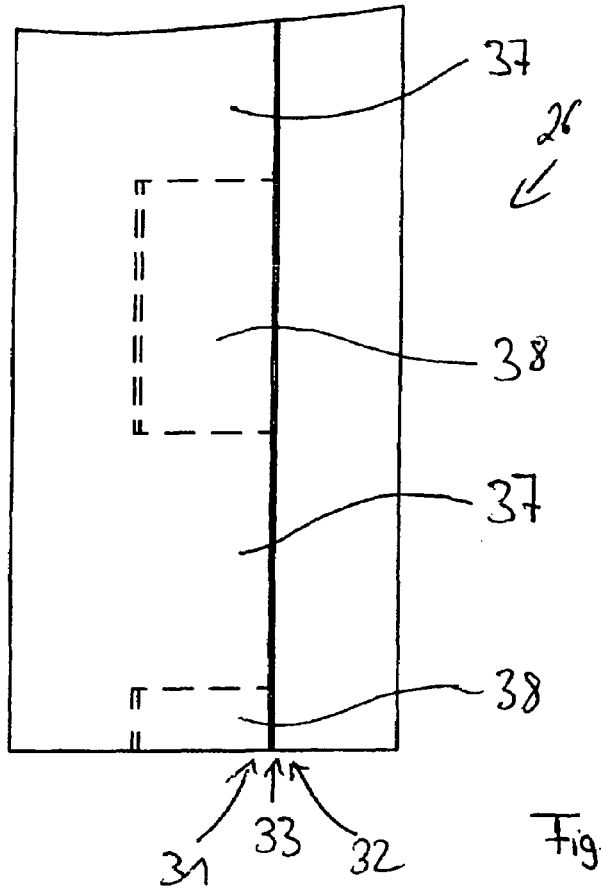
FIG. 7 shows a plan view of the ink transfer device according to the invention from FIG. 5 or 6.
Figure 5:
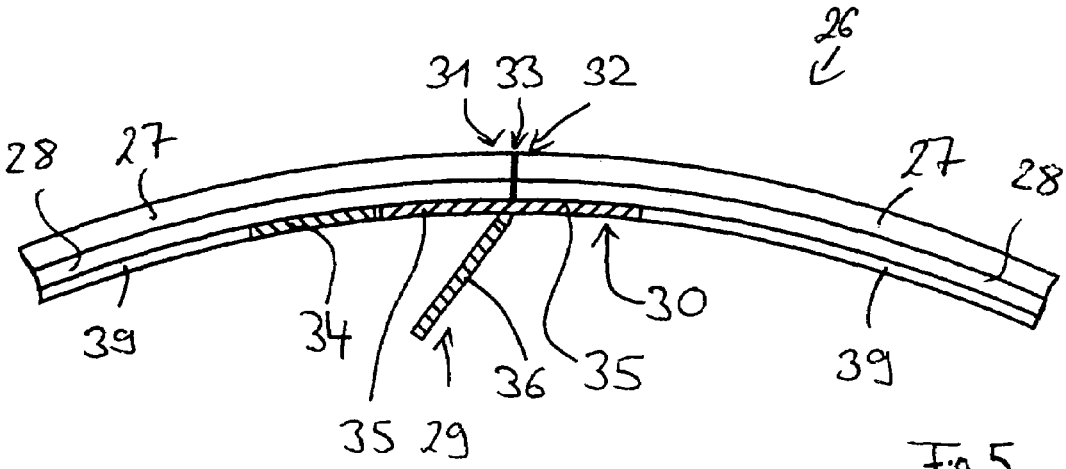
FIG. 5 shows a schematic detail from an ink transfer device according to the invention for a printing press when the same is clamped on a rubber-covered cylinder, in the axial viewing direction according to a fifth exemplary embodiment of the invention.
Figure 6:
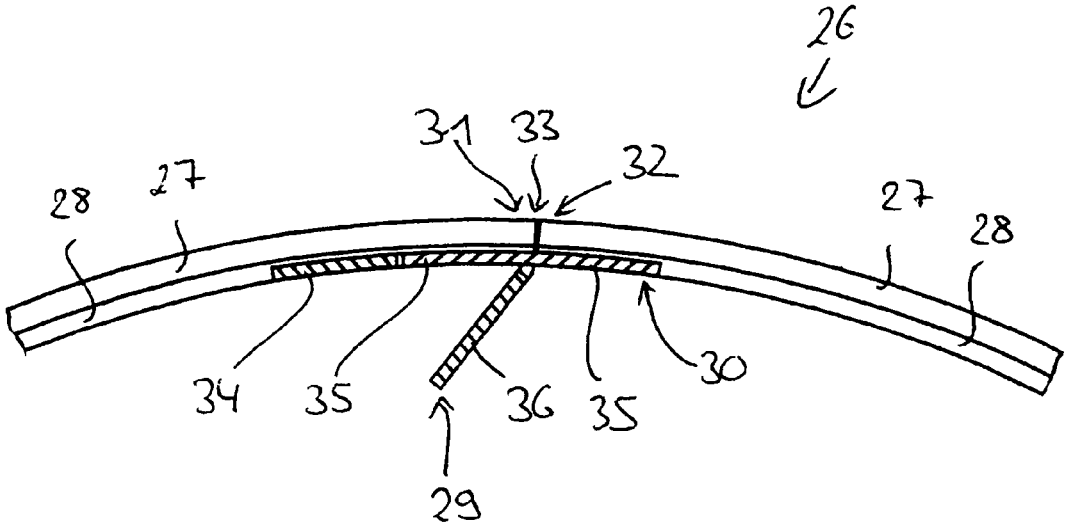
FIG. 6 shows a schematic detail from an ink transfer device according to the invention for a printing press when the same is clamped on a rubber-covered cylinder, in the axial viewing direction according to a further exemplary embodiment of the invention.

FIGS. 5 and 7 show a further exemplary embodiment of an ink transfer device 26 according to the invention. The ink transfer device 26 of FIGS. 5 and 7 again has a rubber blanket 27 and a carrier element 28 which is formed separately and which is designed as a metal carrier or woven fabric carrier or fibre-reinforced plastic carrier. Furthermore, the ink transfer device 26 of FIGS. 5 and 7 has separately formed fixing elements 29 and 30. A first fixing element 29 is firmly connected to the carrier element 28 of the ink transfer device 26 in the region of a leading end 31, and a second fixing element 30 in the region of a trailing end 32. Once more, a non-ink-carrying gap 33 is formed between the leading end 31 and the trailing end 32. Both the fixing element 29 and 30 respectively assigned to the leading end 31 and the trailing end 32 are firmly connected to the carrier element 28 via fixing sections 34 and 35, respectively.

The fixing element 29 assigned to the leading end 31 once again has a clamping section 36 angled over with respect to the fixing section 34. The fixing section 34 and the clamping section 36 of the fixing element 29 assigned to the leading end 31 in this case enclose an angle of less than 90°.

By contrast, the fixing element 30 assigned to the trailing end 32 does not have an angled-over clamping section but, instead, has only the fixing section 35, which, when the ink transfer device 26 is clamped, extends continuously in the circumferential direction.

In the exemplary embodiment of FIGS. 5 and 7, the fixing elements 29 and 30 assigned to the leading end 31 and the trailing end 32 engage in each other with the effect of a toothing system or a zipper. For this purpose, the fixing element 29 assigned to the leading end 31 has a plurality of cut-outs positioned beside one another in the axial direction, so that the fixing section 34 of the same extends over the entire axial width of the ink transfer device 26 but, on the other hand, the clamping section 36 is formed only in some sections 37. In the sections 38 extending beside the sections 37, on the other hand, the fixing element 29 assigned to the leading end 31 has no clamping section 36 bent radially inwards. Instead, the fixing element 30 assigned to the trailing end 32 projects with corresponding projections of the fixing section 35 into the cut-outs of the fixing element 29 assigned to the leading end 31. This results in the toothing system already mentioned of leading end 31 and trailing end 32 and of the fixing elements 29 and 30, it being possible in this exemplary embodiment, too, for a minimal non-ink-transferring gap 33 to be realized between the leading end 31 and the trailing end 32.

In the exemplary embodiment of FIG. 5, the fixing elements 29 and 30 are also placed on the carrier element 28 radially on the inside via their fixing sections 34 and 36. A thickness difference caused hereby is compensated for by a compensating element 39, which again can be connected firmly either to the rubber-covered cylinder or to the carrier element 28. The compensating element 39 can be a constituent part of the fixing elements 29 and 30. Alternatively, the fixing sections 34 and 36 of the fixing elements 29 and 30 (see the exemplary embodiment of FIG. 6) can also once more be let flush into the carrier element 28 radially on the inside. In this case, no thickness difference results and it is possible to dispense with the compensating element 39.

In the spirit of the present invention, an ink transfer device for a printing press is accordingly proposed, of which the leading end and trailing end can be butt-jointed, in order in this way to provide non-ink-transferring gaps between leading end and trailing end of a rubber blanket that have a width in the circumferential direction of between 0 mm and 1.0 mm. This is achieved in that fixing elements which are used for clamping the ink transfer device on the rubber-covered cylinder are designed as separate subassemblies with respect to the rubber blanket and a carrier element of the rubber blanket. This makes it possible to lengthen the extent of rubber blanket and carrier element in the circumferential direction, so that minimal gaps between leading end and trailing end can be maintained.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An ink transfer device which can be clamped on a rubber covered cylinder in a printing press, the device comprising:

a rubber blanket for transferring ink from a printing forme to a printing material, said blanket having a leading end and a trailing end which are separated by a non-ink transferring gap when the device is clamped on the cylinder;

a carrier element fixed to the rubber blanket, the carrier element and the blanket having substantially the same dimensions; and a pair of fixing elements for clamping the blanket on the cylinder, the fixing elements being positioned on the carrier adjacent to respective ends of the blanket, said fixing elements and said carrier element being formed as separate subassemblies which are joined together.

2. The ink transfer device of claim 1, wherein the carrier element is radially inside the blanket when the device is clamped on the cylinder.

3. The ink transfer device of claim 1, wherein the carrier element is an integral constituent part of the rubber blanket.

4. The ink transfer device of claim l, wherein the pair of fixing elements comprise a first fixing element at the leading end and a second fixing element at the trailing end, said fixing elements being positioned radially inside of the carrier element when the device is clamped to the cylinder.

5. The ink transfer device of claim 4, wherein the pair of fixing elements have respective fixing sections which are firmly connected to the carrier element, and respective clamping sections which are bent radially inward with respect to the fixing sections.

6. The ink transfer device of claim 5, wherein the rubber blanket and the carrier element project circumferentially with respect to respective said fixing sections when the device is clamped on the cylinder.

7. The ink transfer device of claim 6, wherein the pair of fixing elements further comprise respective bending sections between the fixing sections and the clamping sections, the rubber blanket and the carrier element projecting circumferentially with respect to respective said bending sections when the device is clamped on the cylinder.

8. The ink transfer device of claim 7, wherein the fixing section and the clamping section of the first fixing element enclose an angle of less than 90° and the fixing section and the clamping section of the second fixing element enclose an angle of greater than 90°.

9. The ink transfer device of claim 4, wherein the rubber blanket and the carrier element have an axial width, the pair of fixing elements extending over the entire axial width the non-ink transferring gap extending over the entire axial width without interruption.

10. The ink transfer device of claim 1, wherein the non-ink transferring gap is sealed.

11. The ink transfer device of claim 1 wherein, the non-ink transferring gap has a circumferential width of at most 1.0 mm.

12. The ink transfer device of claim 1, wherein the pair of fixing elements have respective fixing sections which are firmly connected to the carrier element and extend from of the carrier element, the device further comprising a compensating element connected to the carrier element and flush with the fixing sections.

13. The ink transfer device of claim 12, wherein the compensating element is formed as a film.

14. The ink transfer device of claim 12, wherein the compensating element is connected to the carrier element.

15. The ink transfer device of claim 1 wherein the fixing elements have respective fixing sections which are firmly connected to the carrier element and are flush with the carrier element.

16. The ink transfer device of claim 1, wherein the carrier element is one of a metal carrier, a woven fabric carrier, or a fiber reinforced plastic carrier.

* * * * *